United States Patent [19]

Spiers

[11] Patent Number: 5,025,721

[45] Date of Patent: Jun. 25, 1991

[54] LOCK-IN DEVICE AND METHOD

[75] Inventor: Kent Spiers, Caledonia, Miss.

[73] Assignee: Marathon Equipment Company, Vernon, Ala.

[21] Appl. No.: 452,411

[22] Filed: Dec. 19, 1989

[51] Int. Cl.[5] ..... B30B 15/04

[52] U.S. Cl. ..... 100/229 A; 403/314; 403/353

[58] Field of Search ..... 100/229 A, 244; 403/24, 403/353, 314

[56] References Cited

U.S. PATENT DOCUMENTS

| | | | |
|---|---|---|---|
| 2,970,533 | 2/1961 | Allen | 100/229 A |
| 3,432,966 | 3/1969 | Bordner | 49/370 |
| 3,662,910 | 5/1972 | Herpich et al. | 100/229 A |
| 4,112,623 | 9/1978 | McPherson | 49/488 |
| 4,284,000 | 8/1981 | Almeda, Jr. | 100/229 A |
| 4,424,740 | 1/1984 | Gwathney | 100/52 |
| 4,804,289 | 2/1989 | Blough | 100/229 A |
| 4,811,660 | 3/1989 | Robbins | 100/29 |

FOREIGN PATENT DOCUMENTS 61364 5/1977 Japan .

*Primary Examiner*—David T. Fidei
*Assistant Examiner*—M. D. Patterson
*Attorney, Agent, or Firm*—Shlesinger Arkwright & Garvey

[57] ABSTRACT

This invention is a lock-in device for a trash compactor assembly including a stationary compacting head and support, and a movable container spaced subjacent the compacting head for containing compacted trash. The lock-in device retains the movable container in fixed relation to the vertical compacting head by the action of first and second interlocking members, wherein when the container is locked in position subjacent the compactor the first member can engage with the second member to prevent the container from moving horizontally relative to the compacting head when compacting is taking place. The lock-in device includes first and second members formed of flat plates bent along their longitudinal length to form angled sections and are jointed to the compaction assembly so that they are engageable to prevent horizontal movement of the container relative to the compactor head.

18 Claims, 3 Drawing Sheets

FIG. 6
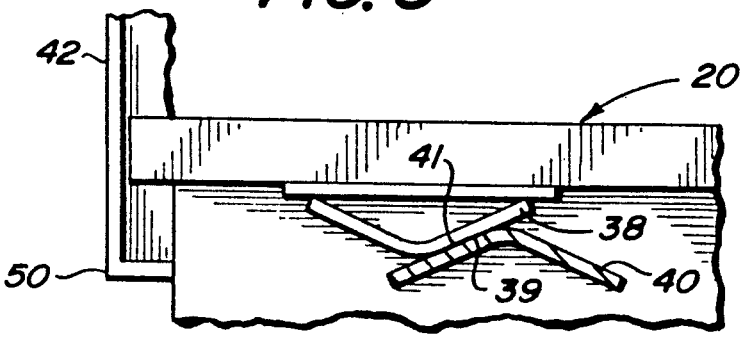
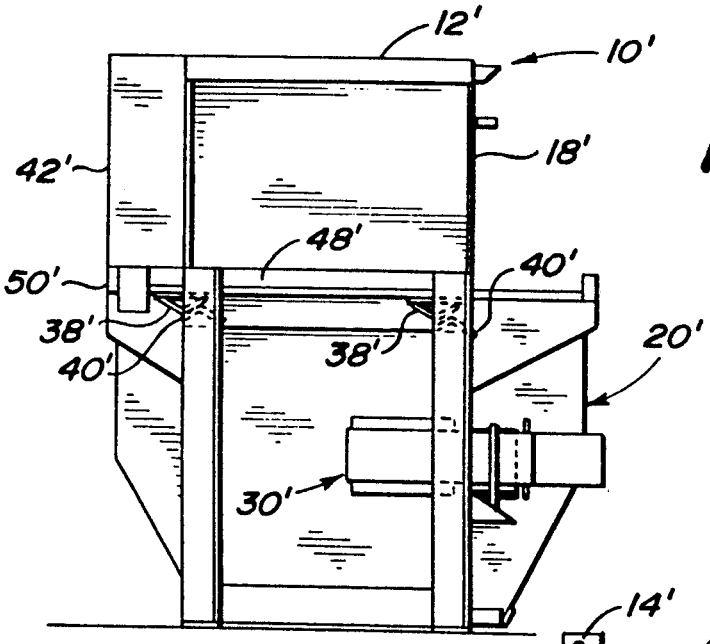
FIG. 7
FIG. 8
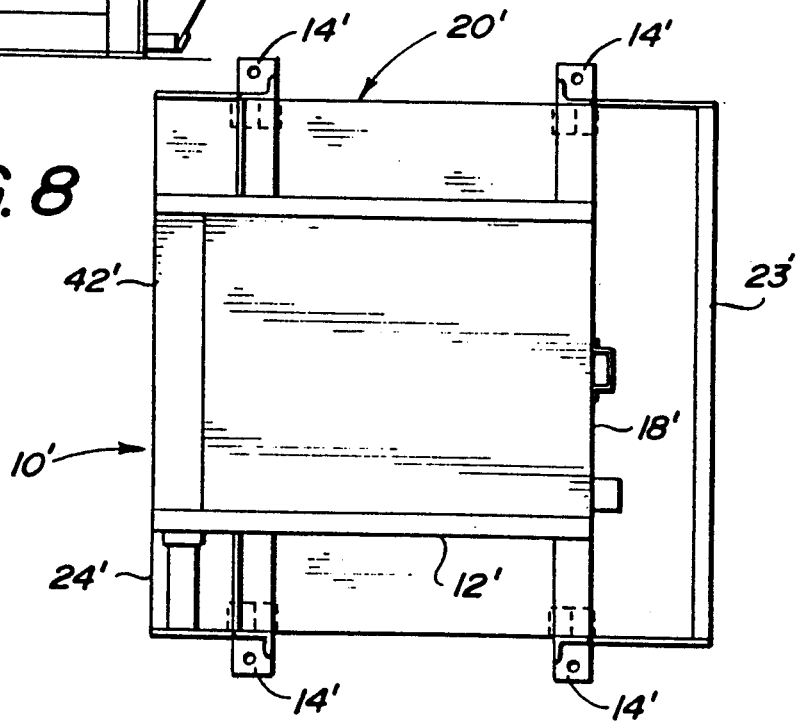

LOCK-IN DEVICE AND METHOD

FIELD OF THE INVENTION

This invention is a mechanical lock-in device for a front loader compaction assembly.

BACKGROUND OF THE INVENTION

A front loader refuse compactor generally comprises a stationary compacting head which delivers the refuse to a removable container that is serviced by a front loader collection vehicle. It is a desirable feature to permit the collection vehicle to remove and dump the container without the operator leaving the truck. This is conventionally accomplished by loading forks which are carried by the truck and which engage complementary pockets arranged along the sides of the container to permit lifting of the container for dumping.

Many compactors rely upon gravity and friction to prevent compacting forces applied by the compacting ram of the compactor head from moving the container away from the head during compaction. Other compactors use a locking arrangement for preventing movement of the container, but these require a sequence of operations requiring skill on the part of the truck driver to lock the container into position. One exemplary arrangement is found in commonly assigned U.S. Pat. No. 4,811,660, issued Mar. 14, 1989, to James K. Robbins, for A Mechanical Lock-in Device for a Front Loader Assembly.

Several disadvantages are associated with the above-identified locking arrangements. As more steps are involved in locking the container beneath the compactor, more time is needed to perform the simple operation. The use of multi-part locking structures increases the cost of the containers. When movable parts are involved, they tend to require frequent repair, and thus cause additional time delays and costs.

In view of the above, it can be seen that there is a need for a device which performs a secure locking function while being economical to construct and install. The disclosed invention provides just such a lock-in device, and one which not only allows quick and easy insertion and removal of the container, but also provides durability and satisfactory performance.

OBJECTS AND SUMMARY OF THE INVENTION

The primary object of the disclosed invention is to provide a durable lock-in device which can stand up to the abuse involved in mechanical trash container handling.

Another object of the disclosed invention is to provide a lock-in device for preventing accidental movement of the refuse container with respect to the compactor head while in operation.

Yet another object is to provide a lock-in device for a front loader compactor assembly which requires no special maneuvers by the front loader truck operator, thereby effecting disengagement of the container from the compactor head by means of the normal procedure which has been followed for removal of such containers.

Still another object is to provide a lock-in device for a front loader compactor assembly wherein the lock-in device is automatically positively engaged when the container is placed in position for compaction of the trash by the compactor head.

In summary, therefore, this invention is directed to a lock-in means for a trash compactor assembly including compacting head means comprising a compactor head and a support for the compactor head, a removable container and a lock-in means for the removable container. The container is normally spaced and locked in position subjacent the compactor head for receiving trash for compaction. The container has fork lift receiving means for receiving a fork lift carried by a loader to effect removal of the container to dump the contents thereof into the loader when the lock-in means is unlocked to permit the container to be removed from the compacting head. The lock-in means includes first and second interlocking means with the first interlocking means being fixedly secured to the compacting head and the second interlocking means fixedly secured to the container and independent from the lift receiving means. The first and second interlocking means are engageable with each other when the container when normally positioned for receiving trash for compaction. The first and second interlocking means are disengageable by lifting the container. When the container is normally positioned, the first and second interlocking means are engageable with each other along complementary sloped cam surfaces.

These and other objects and advantages of the invention will be readily apparent in view of the following description and drawings of the above described invention.

BRIEF DESCRIPTION OF THE DRAWINGS

The above and other objects and advantages and novel features of the present invention will become apparent in the following detailed description of the preferred embodiment of the invention illustrated in the accompanying drawings, wherein:

FIGS. 7 and 8 are side elevational and top plan views respectively, of a second embodiment of the compactor assembly using four lock-in devices.

DETAILED DESCRIPTION OF THE INvENTION

Figure 1:
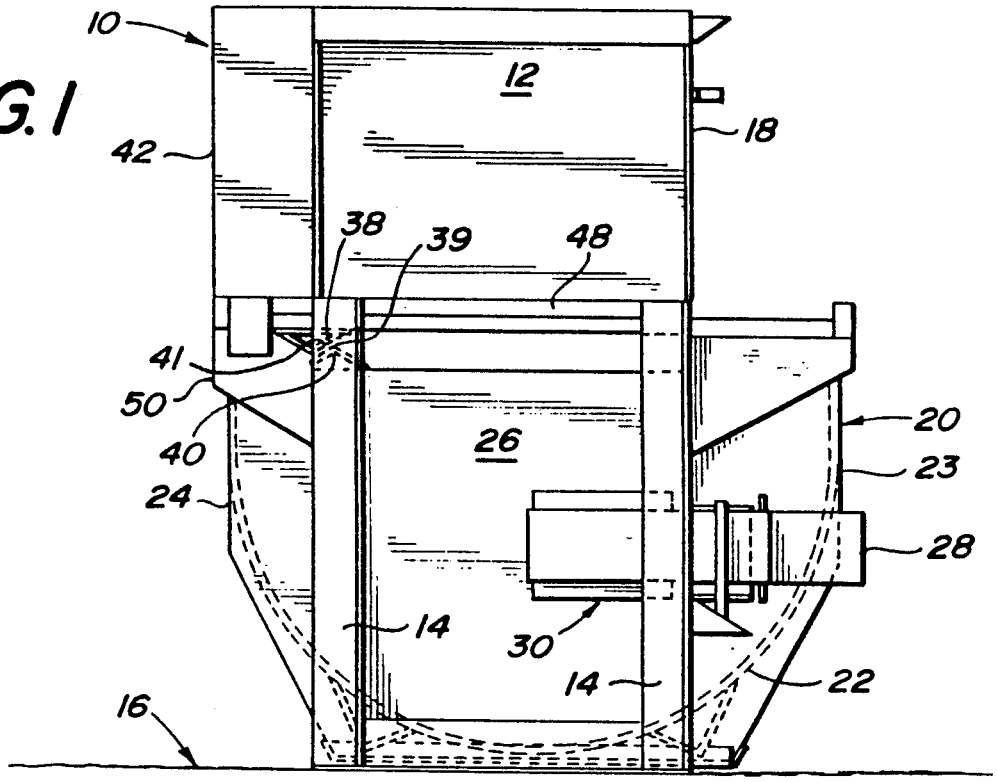
FIG. 1 is a side elevational view with dotted lines illustrating certain parts, disclosing the compactor and container of the invention.

Referring now in greater detail to the drawings, there is illustrated in FIG. 1 a front loader compaction assembly 10 which includes a compactor head 12 supported by a plurality of legs 14 above a ground-supported base 16, the compactor head 12 being provided with a refuse door 18.

A refuse container 20 is supported by base 16 beneath compactor head 12. Container 20 includes an arcuate bottom wall 22, front end wall 23, rear end wall 24 and opposite side walls 26. The fragmentary front loader arms 28 are shown extending into pockets 30 affixed to the opposite sides walls 26 of container 20.

Figure 2:
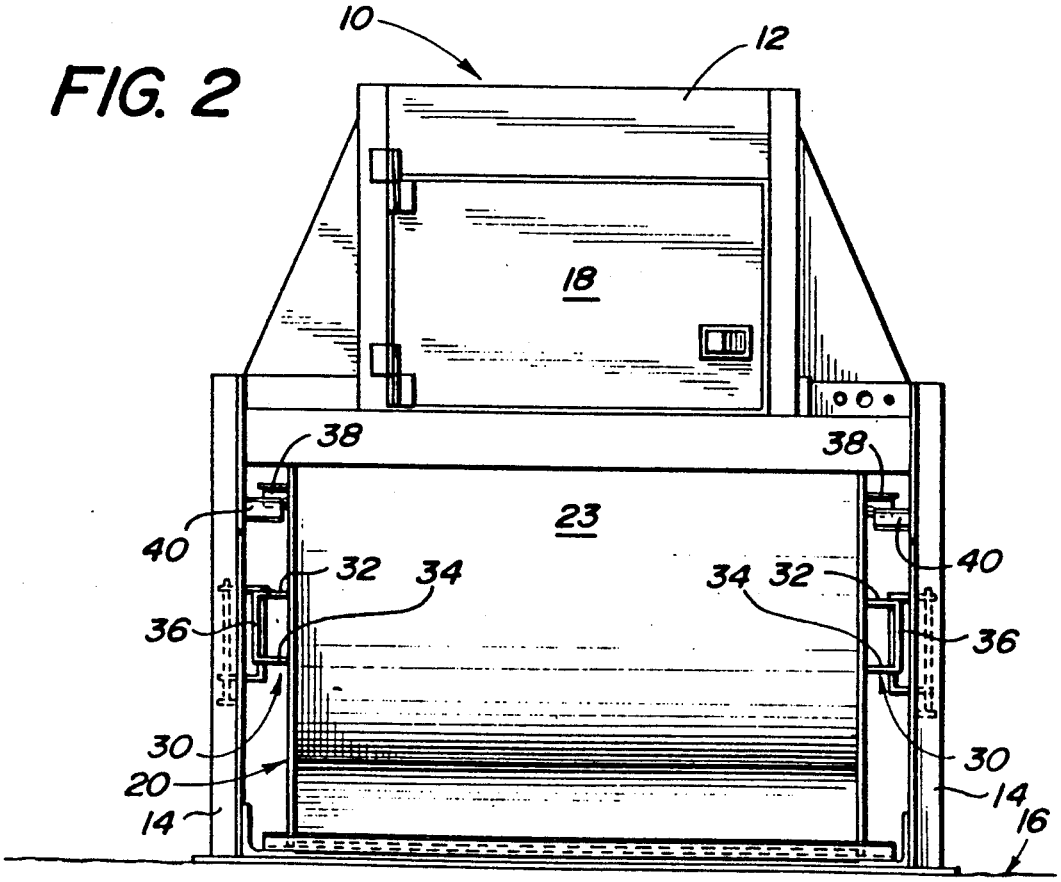
FIG. 2 is a front elevational view thereof.

Pockets 30, as best shown in FIG. 2, are each of channel shape and include a top wall 32 and a bottom wall 34 connected thereto by a pocket side wall 36. Pockets 30 extend only partially along the opposite side walls 26 in order to minimize weight.

Figure 3:
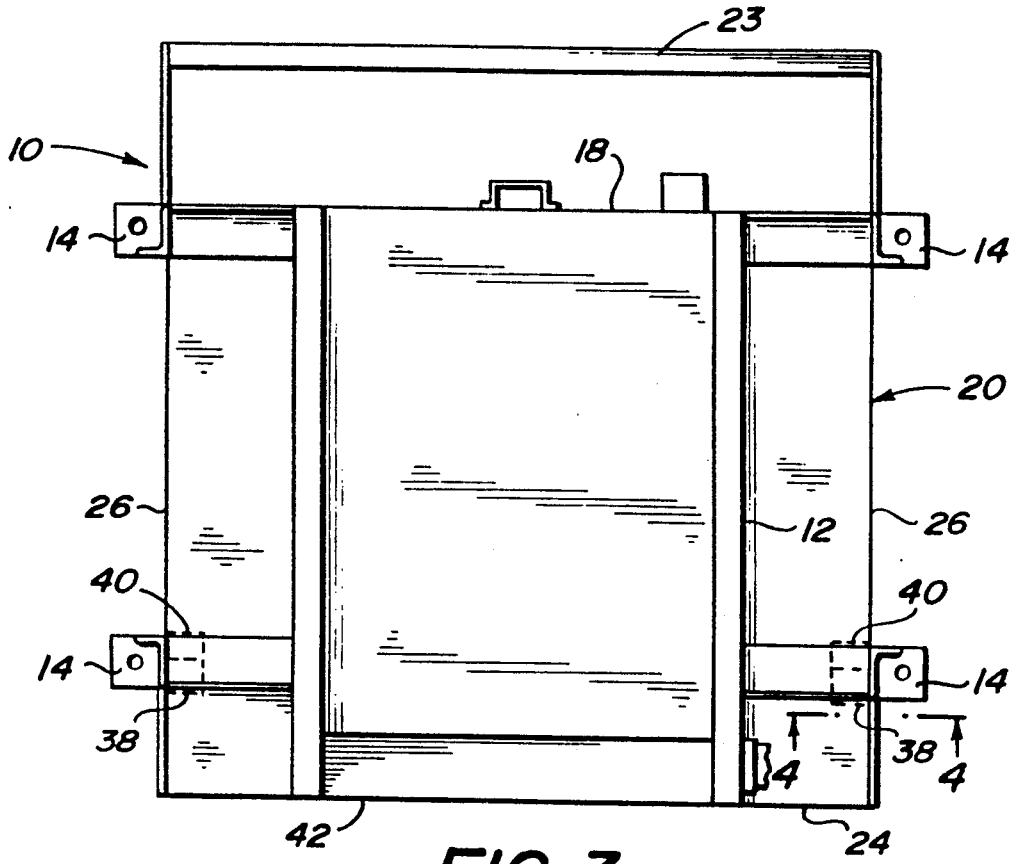
FIG. 3 is a top plan view thereof illustrating a portion of the device by dotted line.

As best shown in FIGS. 1 through 3, the preferred embodiment of the compaction assembly 10 includes an upper lock-in member 38 having a cam surface 39 and a lower lock-in member 40 having a cam surface 41. Cam surfaces 39 and 41 are complementarily engageable sloped surfaces. Upper and lower lock-in members 38 and 40 respectively, are located proximate the rear 42 of compactor assembly 10 along opposite side walls 26 of container 20.

An alternative embodiment is shown in FIGS. 7 and 8 wherein like parts to those of the preferred embodiment are identified by like prime numbers. In the alternative embodiment four pairs of upper and lower locking devices 38' and 40' are used to retain container 20' in position with respect to compactor assembly 10'.

Figure 4:
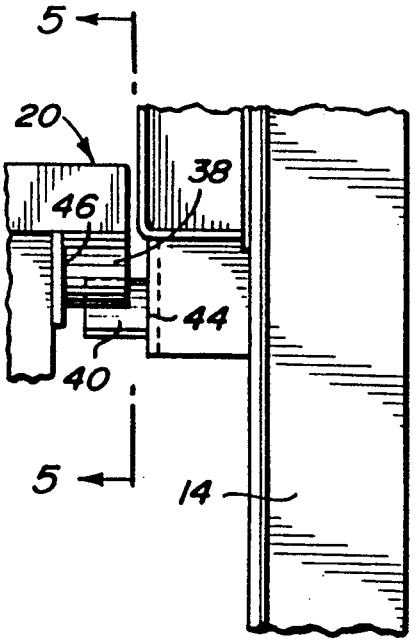
FIG. 4 is a fragmentary elevational view of the compactor assembly showing the lock-in device in an operative position.
Figure 5:
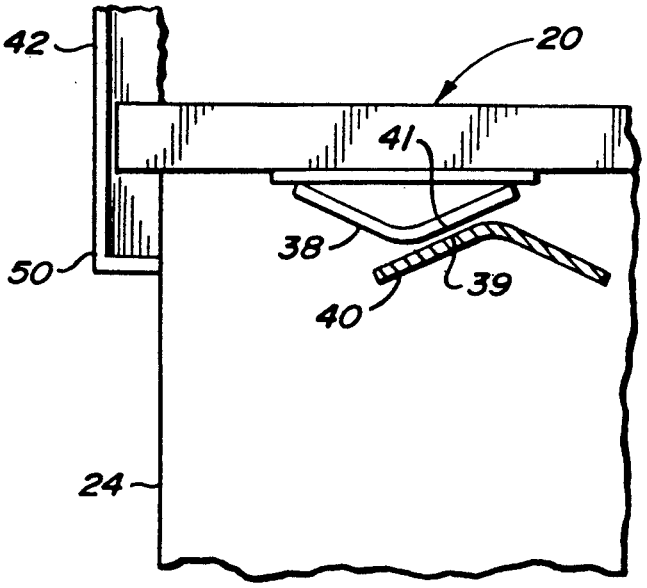
FIG. 5 is a fragmentary side elevational view showing the lock-in device in operational engagement.

As best shown in FIGS. 4 through 6, each lower lock-in member 40 is an elongated flat plate curved to form a continuous and uninterrupted sloped section. As best shown in FIG. 4, each lower member 40 is suitably affixed, such as by welding, along side edge 44 to one of the rear compactor legs 14. Each upper lock-in member 38 is suitably affixed, such as by welding to container 20 along side edge 46. Each upper lock-in member 38 also is an elongated flat plate curved to form a sloped section, but each is a mirror image of each respective lower lock-in member 40. Upper and lower lock-in members 38 and 40 respectively, are preferably, constructed of suitably rigid and durable materials, such as steel and extremely durable plastic.

As shown in FIG. 4, clearance may exist between legs 14 and container sidewall 26 when container 20 is located beneath compactor head 12. Each upper member 38 and each lower member 40 are of suitable width so that they will overlap if the container 20 is spaced from one of legs 14.

While the upper and lower lock-in members 38 and 40, respectively, have been shown in mirror image relation, it is also contemplated that identical curvatures for each member could be used so that when the container 20 is placed beneath the compactor head 12 in the normal position, upper lock-in members 38 will stack either over or into lower lock-in members 40. In either of these two configurations, both lock-in members 38 and 40 are angled or curved in the same vertical direction. Furthermore, the angled V-shape of the lock-in members 38 and 40 has been found to be the most durable design, but a more curved or rounded configuration is contemplated. Also, the members 38 and 40 merely need be flat, angularly disposed, but complementary, bars having engageable complementary cam surfaces.

OPERATION

In use, the lock-in device of the present invention may be applied to both rear sides of the container 20, and compactor assembly 12 as shown in FIG. 3. In accordance with conventional procedure, when a collection vehicle is positioned proximate the compactor assembly, loader arms 28 carried by the vehicle are inserted into side pockets 30, in preparation to move the container 20 away from the compactor head 12, and then raising container 20 for dumping into the collection vehicle.

In accordance with the objects of the disclosed invention, after loading arms 28 are inserted into pockets 30, loading arms 28 lift container 20 above base 16. A space 48 is provided between container 20 and compactor head 12 which allows clearance for container 20 as it is lifted and removed from base 16. Clearance space 48 permits upper lock-in member 38 to pass over lower lock-in member 40 thereby permitting relative horizontal movement between container 20 and compaction assembly 10. When container 20 is set down in position for compaction, upper lock in members 38 rest behind lower lock-in member 40, as best shown in FIG. 5. Rear 42 of compactor assembly 10 includes a channel-shaped depending portion 50 which prevents container 20 from sliding rearwardly when pressure is applied through the compactor head to crush the trash contained in container 20. Upper lock-in members 38 rest behind lower lock-in members 40 and container 20 similarly is prevented from sliding forward by the engagement of the complementary cam surfaces 39 and 41 of upper members 38 and lower members 40 respectively, as best shown in FIG. 6. In this way container 20 is locked into place during the compaction process.

To remove container 20 from beneath compactor head 12, loader arms 28 are inserted into pockets 30 and container 20 is lifted. The lowest point of upper lock-in members 38 is lifted above the highest point of lower lock-in members 40 whereupon container 20 may be pulled from underneath compactor head 12. The lock-in device of the present invention provides an effective lock-in means to prevent "walking" of the refuse container 20 with respect to compactor head 12 of the front loader compaction assembly 10 while it is in operation. The operation of the lock-in device is automatically controlled by the vehicle collection truck inserting the loader arms 28 into the side pockets 30 of the refuse container 26 and lifting to dump the same, and automatically reset in locking engagement when refuse container 20 is repositioned in place. The operation of the present device requires no additional steps or sequence of steps in addition to those which are followed for conventional dumping of the refuse container 20.

While there has been herein shown and described the presently preferred form of the invention, it is to be understood that such has been done for purposes of illustration only and that various changes may be made therein within the scope of the appended claims.

What I claim:

1. In a trash compactor assembly including compacting head means comprising a compactor head and a support for the compactor head; a removable container and lock-in means for the removable container; the container normally spaced and locked in position subjacent the compactor head for receiving trash for compaction; the container having lift receiving means for receiving fork lift loader arms carried by a loader to effect removal of the container to dump the contents thereof into the loader when said lock-in means is unlocked to permit the container to be removed from the compacting head means; said lock-in means comprising:

a) first and second interlocking means, b) said first interlocking means fixedly secured to the compacting head means, c) said second interlocking means fixedly secured to the container, d) said first and second interlocking means being engageable with each other when the container is positioned for receiving trash for compaction, and disengageable from each other upon lifting of the container by the lifting forks and withdrawing of the container from the compactor head, e) the compacting head means having a front end and a rear end, f) said first interlocking means is located below the compacting head and between the front and rear ends, g) the container having a front end and a rear end and side walls between said front and rear ends, said second interlocking means is located between the front and rear ends of the container on a portion of at least one of said side walls and extends outwardly therefrom, h) whereby, the container is prevented from moving forwardly by said first and second interlocking means when a downward force is applied by the compactor head.

2. The lock-in means of claim 1, wherein:

a) said lock-in means includes at least one pair of said first and second interlocking means.

3. The lock-in means of claim 1, wherein:

a) said lock-in means includes front and rear cooperating pairs of said first and second interlocking means.

4. The lock-in means of claim 2, wherein:

a) said lock-in means includes a cooperating cam surface on each of said pairs of said first and second interlocking means.

5. The lock-in device of claim 3, wherein:

a) said lock-in means includes a cooperating cam surface on each of said pairs of said first and second interlocking means.

6. The lock-in device of claim 4, wherein a) each said cam surface is curved.

7. The lock-in device of claim 5, wherein:

a) each said cam surface is curved.

8. The lock-in device of claim 4, wherein:

a) each said cam surface is inclined.

9. The lock-in device of claim 5, wherein:

a) said cam surface is inclined.

10. The lock-in means of claim 2, wherein:

a) said first and second interlocking means each having a highest point and a lowest point so that when the container is rested subjacent the compactor head said second interlocking means is positioned behind and below said first interlocking means, thereby preventing removal of the container, and b) when said container is lifted by the loader, said lowest point of said second interlocking means is above said highest point of said first interlocking means and the container may be removed from the compactor head.

11. The lock-in device of claim 3, wherein:

a) said first and second interlocking means each having a highest point and a lowest point, so that when the container is rested subjacent the compactor head, said lowest point of said second interlocking means is positioned behind and below said highest point of said first interlocking means, thereby preventing removal of the container, and b) when the container is lifted by the loader, said lowest point of said interlocking means is above said highest point of said first interlocking means and the container may be removed from the compacting head means.

12. The lock-in means of claim 2, wherein:

a) said first interlocking means having a cam surface, b) said second interlocking means having a cam surface, c) said cam surface of said second interlocking means being rearward of said cam surface of said first interlocking means relative to said trash compacting head means when said container is subjacent said compactor head.

13. The lock-in device of claim 3, wherein:

a) said first interlocking means having a cam surface, b) said second interlocking means having a cam surface, c) said cam surface of said second interlocking means being slightly rearward of said cam surface of said first interlocking means relative to said trash compactor head means when said container is normally positioned subjacent said compactor head.

14. A trash compactor assembly, comprising:

a) compacting head means including a compactor head and a support for said compactor head, b) a removable container and lock-in means for said removable container, c) said container normally spaced and locked in position subjacent said compactor head for receiving trash for compaction, d) said container having lift receiving means for receiving loader arms carried by a loader to effect removal of said container when said lock-in means is unlocked to permit said container to be removed from said compacting head means, e) said lock-in means including first and second interlocking means, f) said container having a front end and a rear end and side walls located between said ends, said first interlocking means is fixedly secured to said container between said front and rear ends on a portion of at least one of said side walls and extends outwardly therefrom, g) said second interlocking means fixedly secured to said compactor head means, h) said first and second interlocking means being engageable with each other when said container is subjacent said compactor head, i) said first and second interlocking means being disengageable by lifting said container so that said container can be removed, j) said first and second interlocking means being positioned directly beneath said compactor head when said container is located beneath said compactor head, and k) said first and second interlocking means cooperate to prevent horizontal movement of said container during trash compaction.

15. The trash compacting assembly of claim 14, wherein:

a) said first and second interlocking means each having a highest point and a lowest point so that when said container is rested subjacent said compactor head said second interlocking means is positioned behind and below said first interlocking means, thereby preventing removal of said container, and b) when said container is lifted by the loader, said lowest point of said second interlocking means in above said highest point of said first interlocking means and said container may be removed from said compacting head means.

16. The trash compactor assembly of claim 15, wherein:

a) said first interlocking means having a cam surface, b) said second interlocking means having a cam surface, c) said cam surface of said second interlocking means being rearward of said cam surface of said first interlocking means relative to the trash compacting head means when said container is subjacent said compacting head.

17. The trash compactor assembly of claim 15, wherein:

a) said lock-in means includes at least one pair of said first and second interlocking means.

18. The lock-in means of claim 4, wherein:

a) said cooperating cam surfaces are of complementary shape and are form substantially equivalent engagement surfaces.

* * * * *